US008978739B2

(12) United States Patent
Chang

(10) Patent No.: US 8,978,739 B2
(45) Date of Patent: Mar. 17, 2015

(54) HEAT DISSIPATING DEVICE

(75) Inventor: Chin-Ming Chang, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1057 days.

(21) Appl. No.: 13/031,579

(22) Filed: Feb. 21, 2011

(65) Prior Publication Data

US 2012/0168120 A1 Jul. 5, 2012

(30) Foreign Application Priority Data

Dec. 31, 2010 (TW) ..... 99147174 A

(51) Int. Cl.

| | |
|---|---|
| ***F28F 9/00*** | (2006.01) |
| ***F28F 7/00*** | (2006.01) |
| ***E04G 3/00*** | (2006.01) |
| ***A47F 5/00*** | (2006.01) |
| ***F16M 11/06*** | (2006.01) |
| ***F16M 11/08*** | (2006.01) |
| ***F16M 11/14*** | (2006.01) |
| ***F01D 25/00*** | (2006.01) |
| ***F04D 29/60*** | (2006.01) |
| ***F01D 25/24*** | (2006.01) |
| ***H05K 7/20*** | (2006.01) |
| ***F28D 15/02*** | (2006.01) |
| *F28D 21/00* | (2006.01) |

(52) U.S. Cl.

CPC ..... *F28F 9/002* (2013.01); *F28D 15/0275* (2013.01); *F28D 2021/0031* (2013.01)

USPC ..... 165/67; 165/80.3; 165/80.2; 248/274.1; 248/288.11; 248/289.11; 248/291.1; 248/284.1; 248/282.1; 248/185.1; 248/186.2; 248/183.1; 415/176; 415/177; 415/213.1; 415/214.1; 361/700; 361/719

(58) Field of Classification Search

CPC ..... F04D 29/582; F04D 29/5826; F04D 29/5853; F04D 29/601; H01L 23/467

USPC ..... 165/121, 122, 67, 80.3, 80.2; 361/679.47–679.48, 679.52, 694–695, 361/697, 700; 415/176–178, 213.1, 214.1, 415/126; 248/274.1, 288.11, 289.11, 291.1, 248/284.1, 282.1, 185.1, 186.2, 183.1; 24/457, 458; 403/326, 329

See application file for complete search history.

(56) References Cited

U.S. PATENT DOCUMENTS

| | | | |
|---|---|---|---|
| 7,301,769 | B2 | 11/2007 | Li et al. |
| 7,327,568 | B2 * | 2/2008 | Lin ..... 361/679.48 |

(Continued)

FOREIGN PATENT DOCUMENTS

| | | | |
|---|---|---|---|
| CN | 2736848 | Y | 10/2005 |
| CN | 2860012 | Y | 1/2007 |
| CN | 201115230 | Y | 9/2008 |

*Primary Examiner* — Allana Lewin
*Assistant Examiner* — Dawit Muluneh
(74) *Attorney, Agent, or Firm* — Novak Druce Connolly Bove + Quigg LLP

(57) ABSTRACT

A heat dissipating device for dissipating heat from a heat radiation element includes a base, a fixing frame, a fan, and a securing arm. The fixing frame is fixedly attached to the base, and the fixing frame has two coaxially aligned receiving holes defined therein. The fan includes two coaxially aligned shafts. The aligned shafts are fittingly received in the respective receiving holes, such that the fan is detachably attached to the fixing frame and rotatable about the aligned shafts. The securing arm is rotatably attached to the base, and the securing arm is configured for holding the fan against the base.

17 Claims, 4 Drawing Sheets

(56) References Cited

U.S. PATENT DOCUMENTS

| | | | | |
|---|---|---|---|---|
| 7,349,211 | B2 * | 3/2008 | Chen et al. | 361/695 |
| 2006/0291170 | A1 * | 12/2006 | Hsiao | 361/704 |
| 2007/0097644 | A1 * | 5/2007 | Lu et al. | 361/700 |
| 2009/0044927 | A1 * | 2/2009 | Hwang et al. | 165/80.3 |
| 2009/0154100 | A1 * | 6/2009 | Li et al. | 361/697 |
| 2009/0268403 | A1 * | 10/2009 | Chen et al. | 361/692 |
| 2012/0125566 | A1 * | 5/2012 | Liu et al. | 165/67 |

* cited by examiner

HEAT DISSIPATING DEVICE

BACKGROUND

1. Technical Field

The disclosure generally relates to heat dissipating devices and, particularly, to a heat dissipating device with a fan.

2. Description of Related Art

Currently, a thermal module may be provided to dissipate heat from a heat radiation element such as a CPU mounted on a motherboard. In general, a typical thermal module includes a fan and a metallic base. In assembly, the metallic base is mounted on the motherboard first. Then the fan is mounted on the metallic base by fasteners such as screws. Subsequently, the motherboard is installed in a computer case. In use, heat from the CPU is transferred to the metallic base and is further dissipated to the atmosphere with the fan.

However, nowadays the computer case is manufactured smaller to meet miniaturization requirement, and the fan is installed onto the motherboard by manual operation from peripherals of the fan, using a screwdriver, for example. As such, when the fan is broken and needs replacement or repair, the computer case cannot accommodate the screwdriver operated by hands, to detach the fan from the motherboard directly. Instead, the fan can be replaced or can be repaired only after the motherboard has been detached from the computer case and removed, and then the fan can be detached from the motherboard. When the fan is replaced or is repaired, the new fan is again installed to the motherboard, and the motherboard is reinstalled in the computer case. It is, therefore, very difficult to replace or repair the fan in the computer case.

Therefore, what is needed, is a heat dissipating device, which can overcome the above shortcomings.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Embodiment of the heat dissipating device will now be described in detail below and with reference to the drawings.

Figure 1:
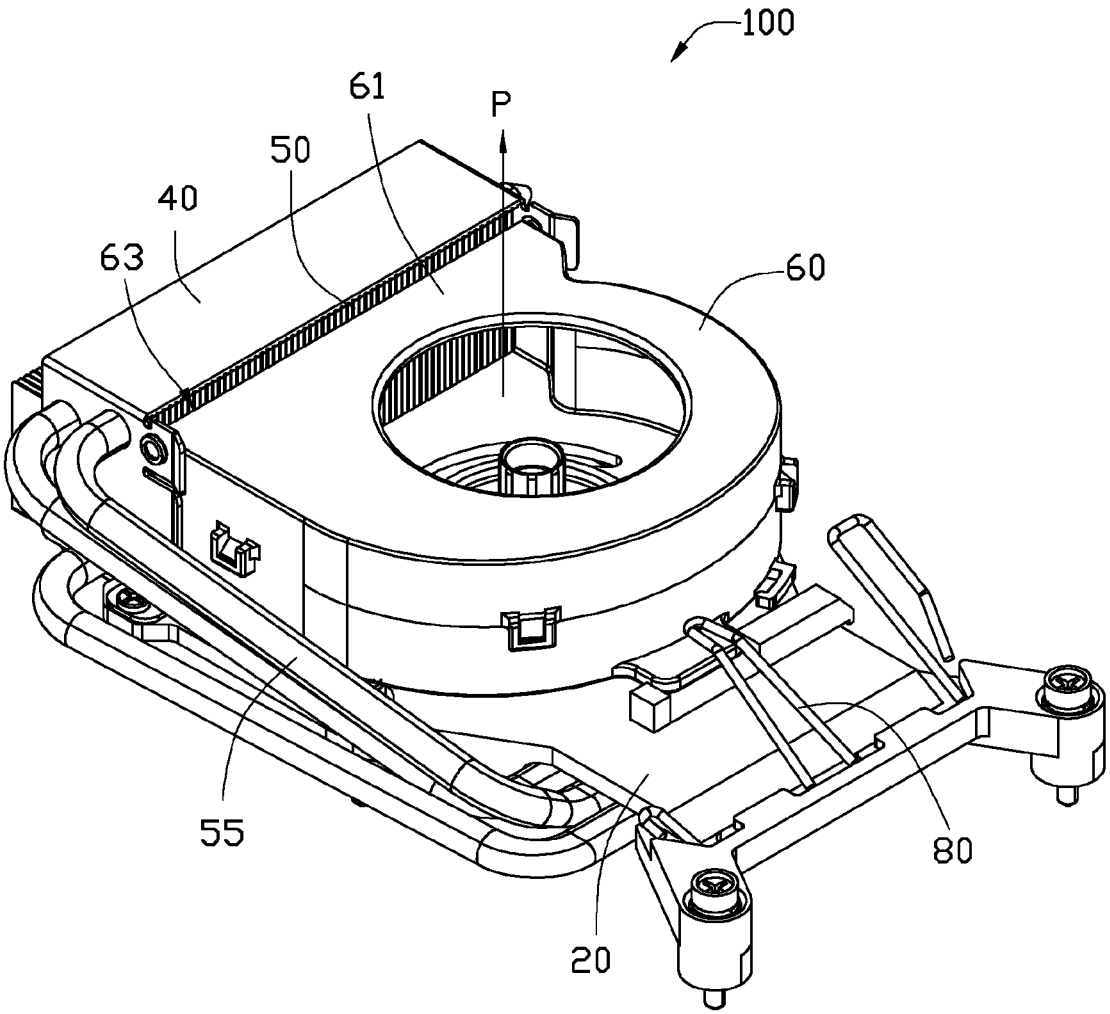
FIG. 1 is an isometric and assembled view of a heat dissipating device according to an embodiment, the heat dissipating device including a fan.

Referring to FIG. 1, a heat dissipating device 100 in accordance with an embodiment is shown. The heat dissipating device 100 dissipates heat from a heat radiation element such as a CPU. The CPU may be mounted on a motherboard, for example. In this embodiment, the heat dissipating device 100 includes a support base 20, a fixing frame 40, a number of heat sinks 50, a number of heat pipes 55, a fan 60, and a securing arm 80.

Figure 2:
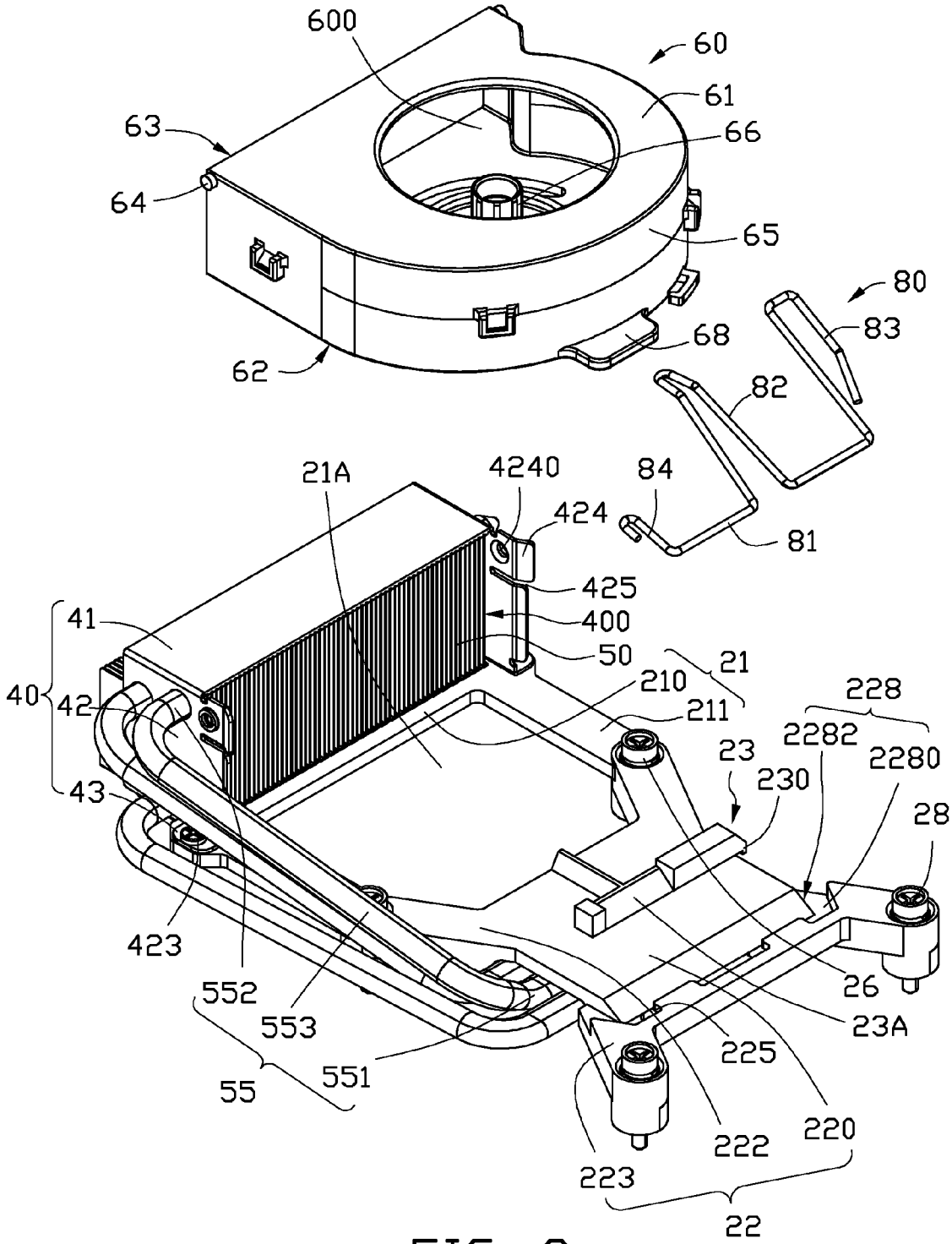
FIG. 2 is an isometric and exploded view of the heat dissipating device of FIG. 1.

Referring to FIG. 1 and FIG. 2, the base 20 includes a first base board 21 and a second base board 22. The first base board 21 includes a first main body 210 and two first supporting arms 211. The first main body 210 is substantially rectangular plate-shaped. The first supporting arms 211 protrude from a side of the first main body 210. The two first supporting arms 211 are substantially parallel to each other. The first main body 210 and the first supporting arms 211 cooperatively define a groove 21A. The second base board 22 includes a second main body 220, two second supporting arms 222, and two third supporting arms 223. The second main body 220 is substantially rectangular plate-shaped. The second supporting arms 222 and the third supporting arms 223 protrude from four corners of the second main body 220. The second supporting arms 222 are located nearer to the first base board 21. The two third supporting arms 223 are located farther from the first base board 21. In assembly, the first base board 21 is attached to the second base board 22 and a motherboard by two first screws 26. The second base board 22 is attached to the motherboard by two second screw 28. In this embodiment, the second supporting arms 222 are overlapping the respective first supporting arms 211, and the first screws 26 extend through the respective second supporting arms 222 and the respective first supporting arms 211 in sequence, to be threadedly attached to the motherboard. The second screws 28 extend through the respective third supporting arms 223 to be threadedly attached to the motherboard. As such, the base 20 is firmly attached to the motherboard. In this embodiment, when the base 20 is attached to the motherboard, a surface of the motherboard is exposed in the groove 21A. The CPU fully contacts the base 20, the same as the second base board 22 of the base 20.

The fixing frame 40 is attached to the base 20, and secures the heat sinks 50 on the base 20. The heat sinks 50 are arranged in a row, and are substantially parallel to one another. In this embodiment, the fixing frame 40 is substantially U-shaped. That is, the fixing frame 40 includes a top board 41 substantially parallel to the first base board 21, and two pedestals 42 extending downwards from opposite ends of the top board 41. The top board 41, the pedestals 42, and the first base board 21 cooperatively define a first receiving space 400 receiving the heat sinks 50. In this embodiment, the top board 41 is substantially rectangular. The fixing frame 40 includes two flanges 43 extending from the two pedestals 42 in opposite directions. In addition, the pedestals 42 extend horizontally toward the second base board 22. Each of the pedestals 42 includes an extension portion 424 protruding from the top board 41. In assembly of the fixing frame 40, the fixing frame 40 is fixed to the first base board 21 by two third screws 423. The two third screws 423 extend through the corresponding flanges 43 and the first base board 21 to be threadedly attached to the motherboard. The top board 41 of the fixing frame 40 abuts against the heat sinks 50, such that the heat sinks 50 fully contact the first base board 21. With this configuration, the heat sinks 50 are used to dissipate heat from the first base board 21. In alternative embodiments, adhesive or glue can be coated on the surfaces of the heat sinks 50, and the heat sinks 50 can be firmly attached to the first base board 21 via the adhesive or glue. The heat sinks 50 thus dissipate heat from the first base board 21 efficiently.

In this embodiment, the heat sinks 50 are spaced from one another to form a corresponding space between each two neighboring heat sinks 50. The spaces allow airflow therethrough to draw heat away from the heat sinks 50. In alternative embodiments, the fixing frame 40 may be structured and arranged in another configuration to secure the heat sinks 50 on the base 20.

Each of the heat pipes 51 includes an evaporator section 551, a condenser section 552, and a connection section 553 located between and connected to the evaporator section 551 and the condenser section 552. The condenser sections 552 are attached to the heat sinks 50. In this embodiment, extending from the condenser sections 552 are two pedestals 42, the heat sinks 50 are disposed between the two pedestals 42 in a way that they abut against the heat sinks 50. The connection sections 553 are deformed, and extend from the heat sinks 50 to the base 20. The evaporator sections 551 extend through the second base board 22 to fully contact the second base board 22 to be located adjacent to the CPU. In use, heat from the CPU is transferred from the evaporator section 551 to the condenser section 552, and the heat sinks 50 dissipate heat from the condenser section 552.

Figure 3:
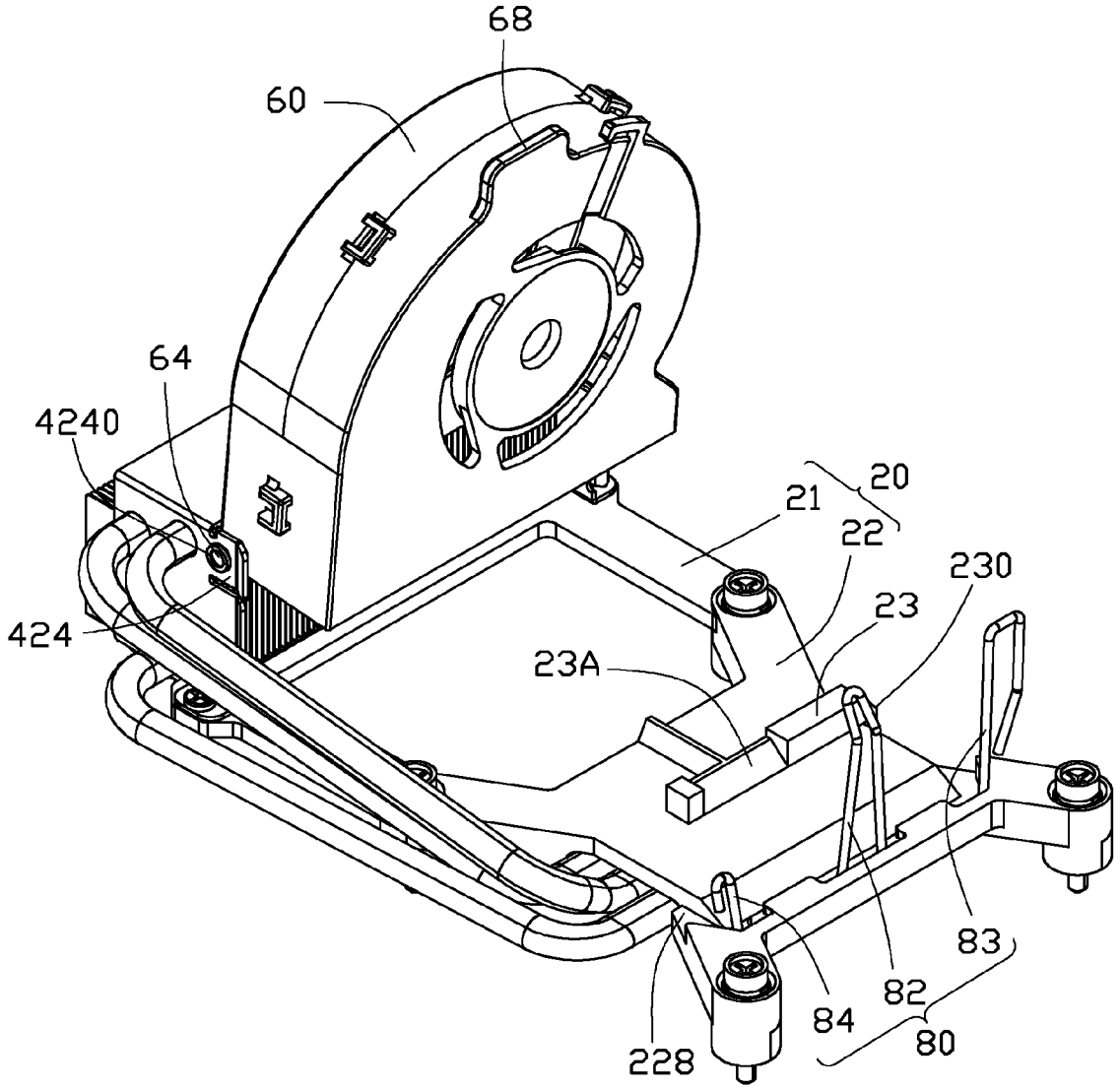
FIG. 3 is an isometric view of the heat dissipating device of FIG. 1, showing the fan being rotated.
Figure 4:
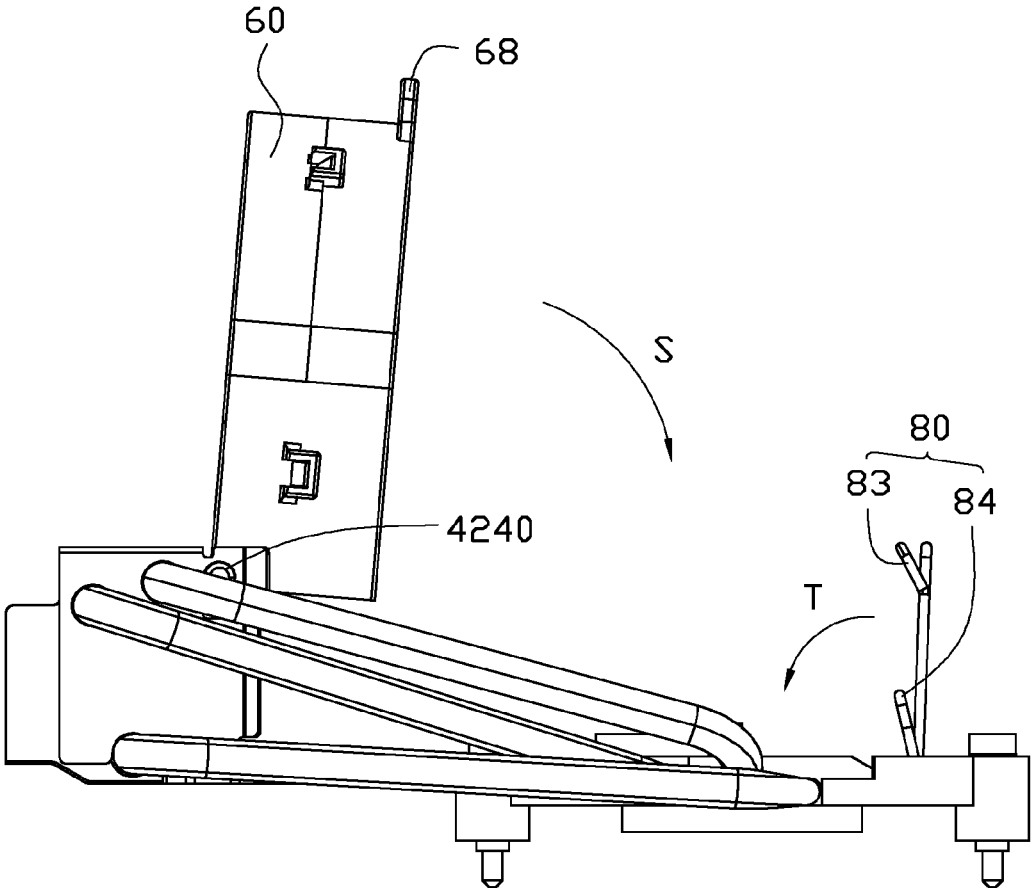
FIG. 4 is a side plane view of the heat dissipating device of FIG. 3.

Referring to FIG. 3 and FIG. 4, the fan 60 is pivotably attached to the fixing frame 40. The fixing frame 40 includes two first pivoting portions 4240. The fan 60 includes two second pivoting portions 64. The two first pivoting portions 4240 and the two second pivoting portions 64 engage with each other, such that the fan 60 can be rotated relative to the fixing frame 40. In this embodiment, the two first pivoting portions 4240 are two receiving holes 4240. The two second pivoting portions 64 are two shafts 64. The two receiving holes 4240 are defined in the respective extension portions 424, and coaxially are aligned with each other. The two shafts 64 are extending from opposite sides of the fan 60, and are coaxially aligned with each other. The two shafts 64 are fittingly received in the respective receiving holes 4240, such that the fan 60 can be rotated about the axes of the aligned receiving holes 4240.

In alternative embodiments, the two first pivoting portions 4240 may be two shafts. The two second pivoting portions 64 may be two corresponding receiving holes receiving the shafts. In other alternative embodiments, the fixing frame 40 may include only a receiving hole or a shaft, the fan 60 may include only a corresponding shaft or a corresponding receiving hole. By inserting the shaft and in the corresponding receiving hole, the fan 60 can also be rotated relative to axes of the receiving hole.

In this embodiment, the fan 60 includes a first surface 61, a second surface 62, a plane surface 63, and a curved surface 65. The first surface 61 and the second surface 62 are located at opposite sides of the fan 60. The plane surface 63 and the curved surface 65 each are located between and adjoin the first surface 61 and the second surface 62. The curved surface 65 is in substantially U-shaped configuration. The curved surface 65 adjoins the plane surface 63.

The fan 60 includes a number of blades (FIG. 2 shows only a rotation axis 66 of the blades), and the fan 60 has a second receiving space 600 receiving the blades. The second receiving space 600 is exposed at the first surface 61 and the plane surface 63. The two shafts 64 extend from opposite portions of the curved surface 65, which adjoin the plane surface 63 nearer to the first surface 61. In addition, the fan 60 includes a protrusion 68 protruding from the curved surface 65. The protrusion 68 is located nearer to the second surface 62 and further from the first surface 61. In operation, the fan 60 can be rotated in a clockwise direction S shown in FIG. 4. The first surface 61 is substantially coplanar with the top board 41 when the fan 60 is rotated to abut against the base 20.

When the fan 60 abuts against the base 20, the plane surface 63 of the fan 60 is located adjacent to the heat sinks 50. The blades of the fan 60 can be rotated to generate airflow through the spaces of the heat sinks 50, thus drawing heat away from the heat sinks 50, and increasing heat dissipating efficiency of the device 100. In this embodiment, the second receiving space 600 of the fan 60 and the groove 21A cooperatively define an air flowing channel P (see FIG. 1). The airflow generated by the blades of the fan 60 can be used to draw the heat from a surface of the motherboard (the heat is generally generated by the CPU) along the air flowing channel P to an exterior of the fan 60.

The fixing frame 40 is suitable to be deformed or is flexible, thus the two extension portions 424 can be distorted slightly in opposite directions, and the two shafts 64 can be easily inserted into respective receiving holes 4240. In this embodiment, the fixing frame 40 can be a galvanized steel plane sheet. Each of the extension portions 424 has a slot 425 defined therein. The slot 425 is defined adjacent to the receiving hole 4240, and is configured for spacing a section of the extension portion 424 with the receiving hole 4240 from another section of the extension portion 424 without the receiving hole 4240. Therefore, the sections of the extension portions 424 with the receiving holes 4240 can be distorted slightly in opposite directions easily. In this embodiment, each of the slots 425 extend in a direction substantially parallel to the first base board 21 toward the heat sinks 50 but do not extend to the pedestals 42.

The securing arm 80 abuts the fan 60 against the base 20. In this embodiment, the securing arm 80 is made by deforming a metallic rod, and includes two shaft portions 81, a retaining portion 82, an engaging portion 83, and a restraining portion 84. The two shaft portions 81 are coaxially aligned with each other. The retaining portion 82 is located between and connected to the two respective shaft portions 81. The engaging portion 83 is connected to an end of a shaft portion 81 facing away from the retaining portion 82. The restraining portion 84 is connected to an end of another shaft portion 81 facing away from the retaining portion 82. In this embodiment, the base 20 includes a strip-shaped supporting portion 23 protruding from the second base board 22. The supporting portion 23 has a recess 23A defined therein, and includes a hooked end 230 protruding from a peripheral portion of the second base board 22. For pivotably attaching the securing arm 80 to the base, the second base board 22 has a guiding hole 225 and two steps 228 defined therein. Each step 228 includes a bottom surface 2280 and a side surface 2282. The side surface 2282 is substantially perpendicular to the bottom surface 2280. In assembly, the aligned shaft portions 81 of the securing arm 80 are received in the guiding hole 225. The aligned shaft portions 81 are substantially parallel to the aligned shafts 64. When the fan 60 is rotated in a clockwise direction S shown in FIG. 4, the protrusion 68 abuts against the supporting portion 23 of the second base board 22, and is received in the recess 23A.

As shown in FIG. 4, when the protrusion 68 abuts against the supporting portion 23, the engaging portion 83 can be rotated in a counter-clockwise direction T shown in FIG. 4 about the aligned shaft portions 81. The retaining portion 82 is rotated to retain the protrusion 68 on the supporting portion 23. In this embodiment, the engaging portion 83 cooperates to maintain the protrusion 38 abutting against the supporting portion 230. In this embodiment, the engaging portion 83 engages the hooked end 230, the restraining portion 84, and the engaging portion 83 are located on the respective bottom surfaces 2280 of the steps 228. As such, the two side surfaces 2282 of the steps 228 cooperatively restrain the aligned shaft portions 81 from sliding in the guiding hole 225.

In use, when the fan 60 needs replacement or repair, the engaging portion 83 can be detached from the hooked end 230, and the securing arm 80 can be rotated in the clockwise direction S to disengage the retaining portion 82 away from the protrusion 68. As such, the fan 60 can be rotated in the counter-clockwise direction T, and can be rotated away from the second base board 22. Then the two extension portions 424 can be deformed slightly in opposite directions to disengage the two shafts 64 from the respective receiving holes 4240, and the fan 60 can be detached from the fixing frame 40. When the fan 60 is detached from the fixing frame 40, the fan 60 can be easily replaced or can be repaired.

It is understood that the above-described embodiment is intended to illustrate rather than limit the disclosure. Variations may be made to the embodiment without departing from the spirit of the disclosure. Accordingly, it is appropriate that the appended claims be construed broadly and in a manner consistent with the scope of the disclosure.

What is claimed is:

1. A heat dissipating device for dissipating heat from a heat radiation element, the heat dissipating device comprising:

a base comprising a first base board and a second base board connected to the first base board, wherein a supporting portion extends from the second base board, the supporting portion has a recess defined therein and comprises a hooked end protruding from a peripheral portion of the second base board, the second base board has a guiding hole and two steps defined therein, each step including a bottom surface and a side surface;

a fixing frame attached to the base, the fixing frame comprising at least one first pivoting portion;

a fan detachably attached to the fixing frame and comprising at least one second pivoting portion, the at least one first pivoting portion and the at least one second pivoting portion comprising at least one shaft and at least one receiving hole, the at least one shaft being received in the at least one receiving hole, such that the fan is capable of rotating about the at least one shaft, the fan further comprising a protrusion configured to be received in the recess when the protrusion is abutting against the supporting portion; and a securing arm rotatably attached to the base, and the securing arm configured for holding the fan against the base, wherein the securing arm comprises two shaft portions, a retaining portion located between and connected to the shaft portions, an engaging portion connected to an end of one shaft portion facing away from the retaining portion, and a restraining portion connected to another shaft portion facing away from the retaining portion, the two shaft portions being received in the guiding hole, the retaining portion is configured for retaining the protrusion such that as the fan abuts against the base, the engaging portion and the hooked end cooperate to maintain the protrusion's abutment against the supporting portion, the engaging portion and the restraining portion being located on the bottom surface of the steps, the two side surfaces of the steps cooperatively restraining the shaft portions from sliding in the guiding hole.

2. The heat dissipating device of claim 1, wherein the engaging portion engages the hooked end to maintain the protrusion's abutment against the supporting portion.

3. The heat dissipating device of claim 2, further comprising a plurality of heat sinks, the heat sinks being secured on the base by the fixing frame.

4. The heat dissipating device of claim 2, further comprising a plurality of heat pipes, wherein each of the heat pipes comprises an evaporator section and a condenser section, the condenser section contacts the heat sinks, the evaporator section is arranged adjacent to the heat radiation element.

5. The heat dissipating device of claim 2, wherein the at least one first pivoting portion comprises two coaxially aligned receiving holes, the at least one second pivoting portion comprises two coaxially aligned shafts, the aligned shafts are received in the respective aligned receiving holes.

6. The heat dissipating device of claim 5, wherein the shaft portions are coaxially aligned, the aligned shaft portions are substantially parallel to the aligned shafts.

7. The heat dissipating device of claim 2, wherein the fixing frame comprises a top board oriented toward the first base board, and two pedestals extending downwards from opposite ends of the top board, the two pedestals are fixed on the first base board, each of the pedestals comprises an extension portion protruding from the top board, with the two receiving holes being defined in the respective extension portions.

8. The heat dissipating device of claim 7, wherein each of the extension portions has a slot defined therein, the slot is configured for spacing a section of the extension portion with the receiving hole from another section of the extension portion without the receiving hole.

9. The heat dissipating device of claim 2, wherein the fixing frame is a galvanized steel sheet.

10. A heat dissipating device for dissipating heat from a heat radiation element, the heat dissipating device comprising:

a base comprising a first base board and a second base board connected to the first base board, wherein a supporting portion extends from the second base board, the supporting portion has a recess defined therein and comprises a hooked end protruding from a peripheral portion of the second base board, the second base board has a guiding hole and two steps defined therein, each step including a bottom surface and a side surface;

a fixing frame positioned on the base, the fixing frame comprising at least one shaft;

a fan detachably positioned on the fixing frame, the fan defining at least one receiving hole, the at least one shaft being received in the at least one receiving hole such that the fan is capable of rotating about the fixing frame, the fan further comprising a protrusion configured to be received in the recess when the protrusion is abutting against the supporting portion; and a securing arm rotatably positioned on the base, and the securing arm configured for holding the fan against the base, wherein the securing arm comprises two shaft portions, a retaining portion located between and connected to the shaft portions, an engaging portion connected to an end of one shaft portion facing away from the retaining portion, and a restraining portion connected to another shaft portion facing away from retaining portion, the two shaft portions being received in the guiding hole, the retaining portion is configured for retaining the protrusion such that as the fan abuts against the base, the engaging portion and the hooked end cooperate to maintain the protrusion's abutment against the supporting portion, the engaging portion and the restraining portion being located on the bottom surface of the steps, the two side surfaces of the steps cooperatively restraining the shaft portions from sliding in the guiding hole.

11. The heat dissipating device of claim 10, wherein the engaging portion engages the hooked end to maintain the protrusion abutting the supporting portion.

12. The heat dissipating device of claim 11, further comprising a plurality of heat sinks, the heat sinks being secured on the base by the fixing frame.

13. The heat dissipating device of claim 11, further comprising a plurality of heat pipes, wherein each of the heat pipes comprises an evaporator section and a condenser section, the condenser section contacts the heat sinks, the evaporator section is arranged adjacent to the heat radiation element.

14. The heat dissipating device of claim 11, wherein the shaft portions are coaxially aligned, the aligned shaft portions are substantially parallel to the aligned shafts.

15. The heat dissipating device of claim 11, wherein the fixing frame comprises a top board oriented toward the first base board, and two pedestals extending downwards from opposite ends of the top board, the two pedestals are fixed on the first base board, each of the pedestals comprises an extension portion protruding from the top board, with the two receiving holes being defined in the respective extension portions.

16. The heat dissipating device of claim 15, wherein each of the extension portions has a slot defined therein, the slot is configured for spacing a section of the extension portion with the receiving hole from another section of the extension portion without the receiving hole.

17. The heat dissipating device of claim 11, wherein the fixing frame is a galvanized steel sheet.

* * * * *